United States Patent [19]

Sullivan

[11] 4,223,408

[45] Sep. 23, 1980

[54] ATHLETIC BRIEFS

[76] Inventor: Edith Sullivan, 51 Osgood St., Belmont, Mass. 01844

[21] Appl. No.: 38,778

[22] Filed: May 14, 1979

[51] Int. Cl.[3] ..... A41D 1/08

[52] U.S. Cl. ..... 2/238

[58] Field of Search ..... 2/238, 227, 404, 228, 2/67

[56] References Cited

U.S. PATENT DOCUMENTS 3,945,051 3/1976 Burkard ..... 2/238

FOREIGN PATENT DOCUMENTS 570945 9/1958 Belgium ..... 2/238

1263993 5/1961 France ..... 2/238

1522492 3/1968 France ..... 2/238

*Primary Examiner*—H. Hampton Hunter

*Attorney, Agent, or Firm*—Charles Hieken

[57] ABSTRACT

Athletic shorts are arranged with front and back panels cut in a peculiar pattern and joined to a pair of briefs by an elastic waistband with the front panel overlapping a portion of the back panel so as to relieve tension of the shorts on the rectus femurs and vastus lateralis muscles of the legs of the wearer.

6 Claims, 8 Drawing Figures

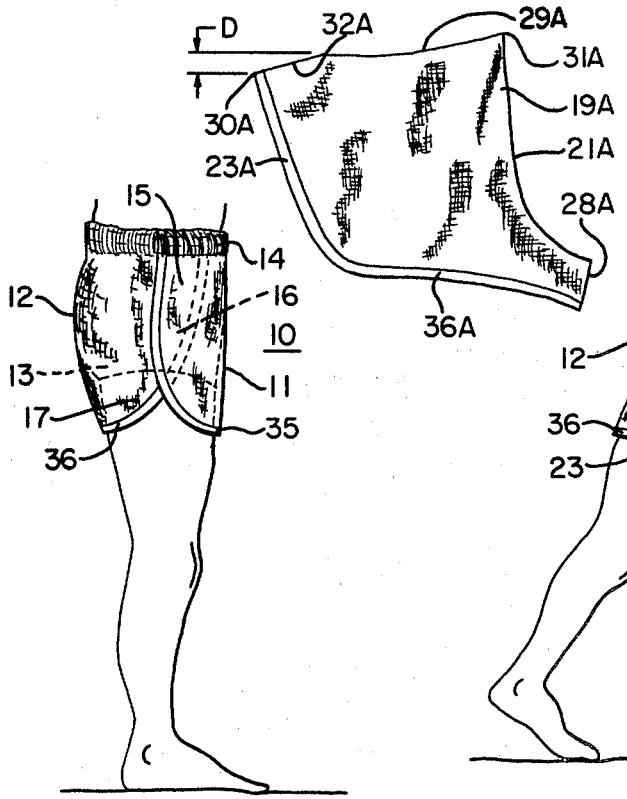
FIG. 5A
FIG. 1
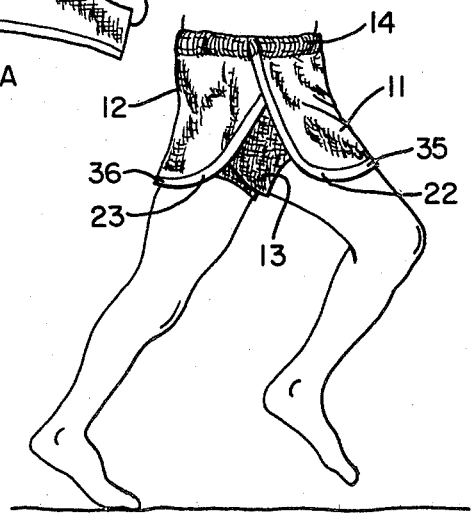
FIG. 6
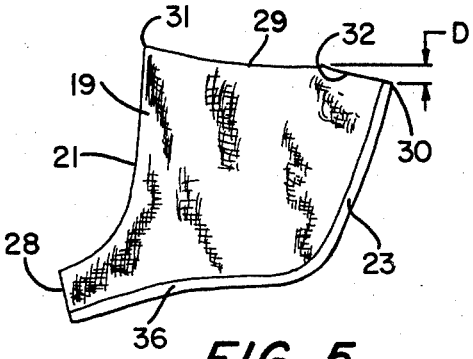
FIG. 5
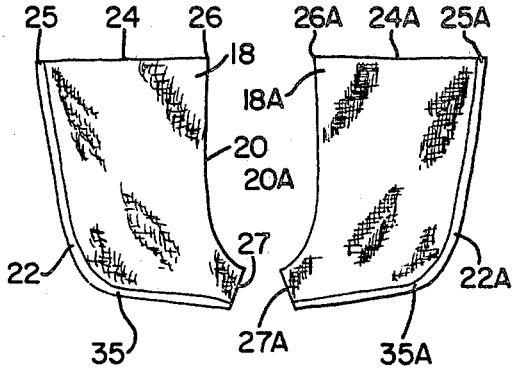
FIG. 4 FIG. 4A
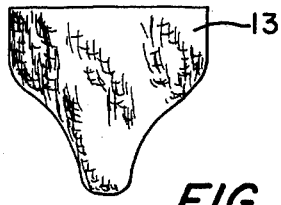
FIG. 3
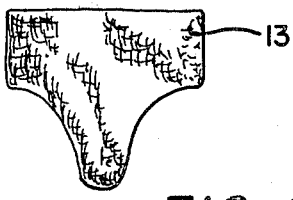
FIG. 2

ATHLETIC BRIEFS

BACKGROUND OF THE INVENTION

The present invention relates in general to athletic shorts, and more particularly, to athletic shorts adapted to relieve tension of the shorts on the rectus femurs and vastus lateralis muscles of the legs of a wearer.

Typically running shorts have leg portions with ends that tend to apply tension to certain leg muscles of the wearer. Attempts to correct this problem have included simply designing leg portions of the shorts with larger openings or slits to relieve the tension. However, these attempts are sometimes ineffective and not particularly pleasing aesthetically.

Accordingly, it is an object of this invention to provide an attractive pair of athletic shorts adapted to relieve tension on the leg muscles of the wearer.

SUMMARY OF THE INVENTION

According to the invention, athletic shorts comprise front panel means having a crotch edge and a waistband edge, back panel means having a crotch edge and a waistband edge that merges with a slanting edge, a pair of briefs, and an elastic waistband means joining briefs to said waistband edges of said front and back panel means. The back panel means is overlapped by the front panel means at sides of the shorts with ends of the overlapped panels being free to move apart. Numerous other features, objects and advantages of the invention will become apparent from the following specification when read in connection with the accompanying drawing in which:

BRIEF DESCRIPTION OF THE DRAWING

FIG. 1 is a side view of the athletic shorts arranged according to the invention;

FIG. 2 is a front view of a pair of briefs;

FIG. 3 is a back view of the briefs shown in FIG. 2;

FIG 4 is a pattern for a front panel half;

FIG. 4A is a pattern for a reverse image of the front panel half shown in FIG. 4;

FIG. 5 is a pattern for a back panel half;

FIG. 5A is a pattern for a reverse image of the back panel half shown in FIG. 5; and FIG. 6 is a side view of the athletic shorts showing relative movement between the front and back panel halves when worn by a runner.

DETAILED DESCRIPTION OF PREFERRED EMBODIMENTS

Referring to FIG. 1, there is shown a pair of athletic shorts 10 arranged according to the invention. The athletic shorts comprise front 11 and back 12 panels joined to a pair of briefs 13, shown in FIGS. 2 and 3, by a suitable waistband 14 such as a four needle waistband, so that the front 11 and back 12 panels are free to move apart at sides 17 of the shorts 10. A portion 15 of the front panel 11 overlaps a portion 16 of the rear panel 12 at the sides 17 of the shorts 10.

Referring to FIGS. 4, 4A, 5 and 5A, there is shown a pattern for front 18 and back 19 panel halves. The front panel 18 is formed by uniting a front edge 20 of the front panel half 18 with a front edge 20A of a reverse image 18A of the front panel half 18 (shown in FIG. 4A). Likewise, the back panel 12 is formed by uniting a back edge 21 of the back panel half 19 with a back edge 21A of a reverse image 19A of the back panel half 19 (shown in FIG. 5A). A bias binding 22, 23 is sewn along an exterior edge of the panels 11, 12 that could be in public view. The front panel half 18 has a waistband edge 24 that extends from an end 25 of the exterior edge 22 to an end 26 of the front edge 20. The waistband edge 24 is sewn to the waistband 14 and briefs 13 and a crotch edge 27 is sewn to a corresponding crotch edge 28 of the back panel half 19. The back panel half 19 also has a waistband edge 29 that is also sewn to the waistband 14 and briefs 13 and extends from an end 30 of the exterior edge 23 to an end 31 of the back edge 21. A small length 32 of the waistband edge 29 is cut at a slant so that the end 30 of the exterior edge 23 is below the waistband edge 29 to minimize stress on the end 30 as the panels move apart when worn by a runner as shown in FIG. 6. As an example, the length 32 of the waistband edge 29 is cut at a slant so that the end 30 of the exterior edge 23 is below the waistband edge 29 by approximately 0.375 inch. It has been determined that overlapping the front 11 and back 12 panels at the sides 17 of the shorts 10 and uniting the panels 11, 12 to the waistband so that ends 35,36 of the panels 11, 12 are free to move apart relieves tension to the rectus femurs and vastus lateralis muscles of the legs of a wearer. It is evident that those skilled in the art may now make numerous uses and modifications of and departures from the specific apparatus and techniques herein disclosed without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Athletic shorts comprising, front panel means having a crotch edge and a waistband edge, back panel means having a crotch edge and waistband edge, said waistband edge having a section cut at a slant, a pair of briefs, and an elastic waistband means joining said briefs to said waistband edges of said front and back panel means, said back panel means being overlapped by said front panel means at sides of said shorts with ends of said overlapped panels being free to move apart.

2. Athletic shorts according to claim 1 wherein said front panel means include a first panel half having a front edge united with a front edge of a second panel half.

3. Athletic shorts according to claim 2 wherein said second panel half is a reverse image of said first panel half.

4. Athletic shorts according to claim 1 wherein said back panel means include a first panel half having a front edge united with a front edge of a second panel half.

5. Athletic shorts according to claim 4 wherein said second panel half is a reverse image of said first panel half.

6. Athletic shorts according to claim 1 wherein said crotch edge of said front panel means is united with said crotch edge of said back panel means.

* * * * *